US009850047B2

(12) United States Patent
Wang

(10) Patent No.: US 9,850,047 B2
(45) Date of Patent: Dec. 26, 2017

(54) AIRTIGHT CONTAINER

(71) Applicants: Jui-Te Wang, Taichung (TW); Jordan S. Tarlow, Venice, CA (US)

(72) Inventor: Jui-Te Wang, Taichung (TW)

(73) Assignees: Jui-Te Wang, Taichung (TW); Jordan S. Tarlow, Venice, CA (US)

( * ) Notice: Subject to any disclaimer, the term of this patent is extended or adjusted under 35 U.S.C. 154(b) by 79 days.

(21) Appl. No.: 14/989,795

(22) Filed: Jan. 7, 2016

(65) Prior Publication Data

US 2017/0197768 A1 Jul. 13, 2017

(51) Int. Cl.

*B65D 51/16* (2006.01)
*B65D 43/26* (2006.01)
*B65D 53/00* (2006.01)

(52) U.S. Cl.

CPC ..... *B65D 51/1644* (2013.01); *B65D 43/26* (2013.01); *B65D 53/00* (2013.01)

(58) Field of Classification Search

CPC .... B65D 51/1644; B65D 53/00; B65D 43/26; A47J 47/06; A47J 47/02; F16K 15/147; F16K 17/19

USPC ..... 220/202, 203.01, 203.04, 203.07, 203.1, 220/203.11, 203.13, 203.17, 203.23, 220/203.24, 203.28, 254.1, 254.2, 256.1, 220/212, 231, 367.1; 215/230, 260, 262, 215/270, 271, 307, 311, 315; 141/65, 83, 141/95; 137/384.2, 384.4, 384.6, 384.8, 137/560; 206/524.8

See application file for complete search history.

(56) References Cited

U.S. PATENT DOCUMENTS 5,397,024 A * 3/1995 Wu ..... B65D 51/1683 215/309
5,697,510 A * 12/1997 Wang ..... B65D 51/1683 215/262
8,701,909 B2 * 4/2014 Endert ..... B65D 43/0212 215/216
2014/0312040 A1 * 10/2014 Gamelli ..... B65D 43/02 220/288
2015/0136770 A1 * 5/2015 Wang ..... F16K 15/147 220/203.22

* cited by examiner

*Primary Examiner* — Kareen Thomas
(74) *Attorney, Agent, or Firm* — Rosenberg, Klein & Lee

(57) ABSTRACT

An airtight container, comprises a container body, a lid member covering the container body, a sieve disposed on the container body and facing the lid member, and a seal control member movable disposed in a channel of the lid member, operable sealing an opening on the channel of the lid member. Wherein the opening is uncovered when pressing the control member, and covering the lid member on the container body such that forming the negative air pressure in the container after releasing the button.

3 Claims, 7 Drawing Sheets

AIRTIGHT CONTAINER

BACKGROUND OF THE INVENTION

1. Field of the Invention

The present invention relates to a container, and more particularly to an airtight container.

2. Description of the Related Art

Seasoning is usually vacuum packed in tins or canisters for reducing interact with oxygen and atmospheric moisture and thereby maintaining the fresh during an extended period of time prior to the use thereof. Once a consumer opens the vacuum packed container, the vacuum is lost.

The closest prior art of which applicants are aware is their prior U.S. Pat. No. 5,397,024 to Wu et al. The cover includes a valve depressible inward of the cover for allowing air to flow inward or outward of the cover. However, the valve assembly includes a screw secured to the plug rod and engaged with the cover for preventing the valve assembly from disengaging from the cover. The screw is normally made of metal and may not be easily threaded into place. In addition, the screw which is made of metal material may not closely enclose the opening of the cover such that a rubber ring and a gasket are required to be engaged on the screw for engaging with the cover so as to enclose the opening. Furthermore, the inner thread of the plug rod may be easily damaged by the metal screw.

SUMMARY OF THE INVENTION

It is an object of the present invention to provide a container, in which hermetic sealing can be simply and economically produced whenever desired.

According to one aspect of the present invention, the container comprises a container body, a lid member, a sieve, and a seal control member. Wherein the lid member is covering on the container body, a channel is formed on the lid member and the channel is defining therein an opening. The sieve is disposed on the container body and facing the lid member, the sieve is defining a storage chamber and a buffer chamber in the container on both sides of the sieve respectively. The seal control member is movable disposed in the channel of the lid member, operable sealing the opening of the lid member. The seal control member has a button, a valve unit, and a spring. A column formed on the button and facing the opening, the valve unit is passed through the opening, a first end of the valve unit is covering the opening and a second end of the valve unit connected the column, the spring is mounted on the column and two ends of the spring is abutting the button and the channel.

In accordance with another aspect of the invention, there is provided a container comprising a container body including an open top, a lid member engaged on top of the container body for enclosing the open top of the container body, the lid member including a channel formed therein and including an opening formed therein and communicating with the channel, a button slidably engaged in the channel and including a tube extended therefrom and having a pair of engaging shoulders formed therein, the button including at least one projection for engaging with the lid member so as to prevent the button from engaging into the channel, a plug including a pair of hooks extended therefrom and a slit formed between the hooks, the hooks being engaged into the tube and engaged with the engaging shoulders of the tube so as to allow the plug to be secured to the tube, and a biasing means biased between the button and the valve unit for biasing the knob partially outward of the cover and for forcing the plug against the cover and for enclosing the opening.

The sieve isolates the seasoning from the opening and gives a buffer chamber, when pressing the button, the airflow does not directly impact the seasoning to spay or contaminate the lid member.

The foregoing and other objectives, features, and advantages of the invention will be more readily understood upon consideration of the following detailed description of the invention, taken in conjunction with the accompanying drawings.

DETAILED DESCRIPTION OF EMBODIMENTS

Figure 1:
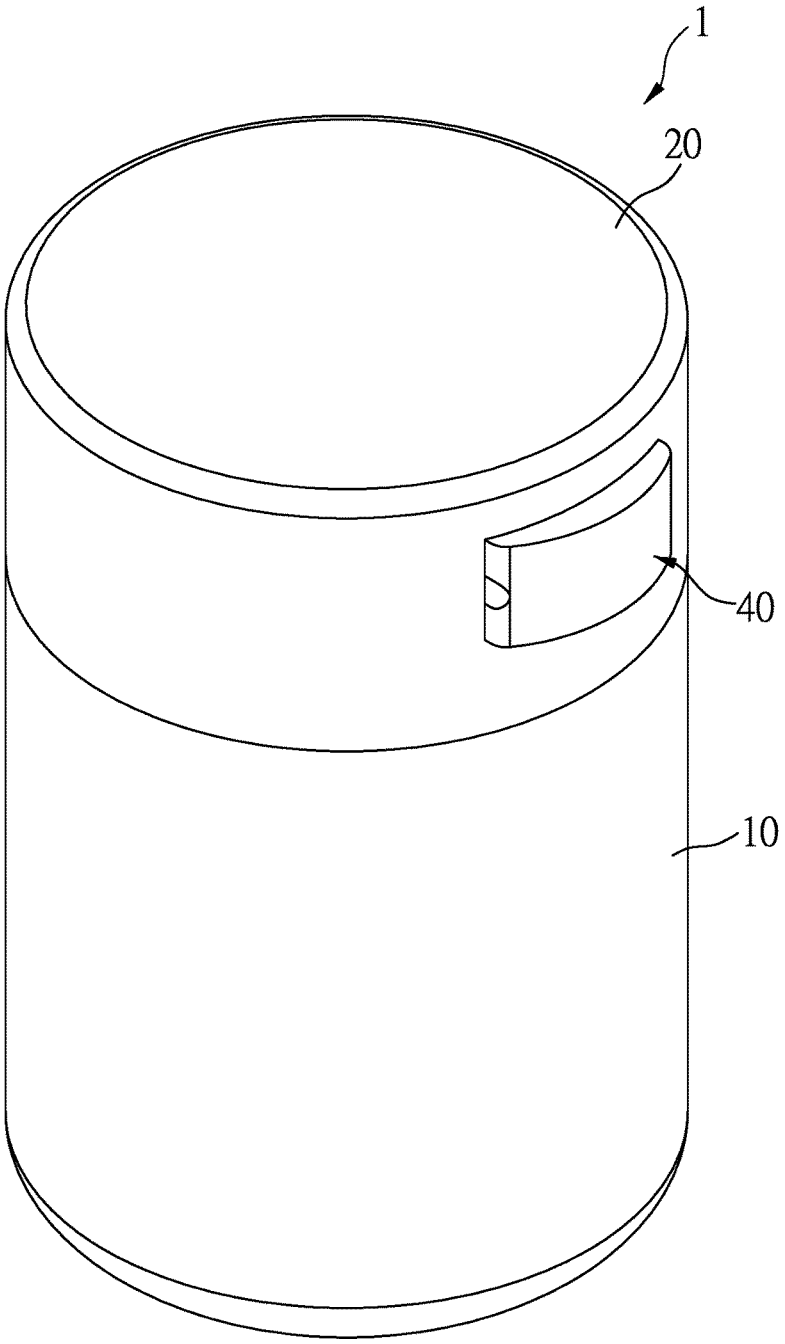
FIG. 1 is a perspective view of a container in accordance with the preferred embodiment of the present invention.

Referring to the FIGS. 1 to 4, an airtight container 1 in accordance with the present invention comprises a container body 10, a lid member 20 covering the container body 10, a sieve 30 disposed on the container body 10 and facing the lid member 20, and a seal control member 40 movable disposed on a channel 21 of the lid member 20.

In detail, the channel 21 is formed on the lid member 20 and the channel 21 defining an opening 22 therein, in other words, the opening 22 is formed within the channel 21. The sieve 30 is disposed on the container body 10 and facing the lid member 20, covering top of the container, the sieve 30 defines a storage chamber 15 and a buffer chamber 25 in the container 1 on both sides of the sieve 30 respectively. The seal control member 40 is disposed on the channel 21 of the lid member 20, operable sealing the opening 22 of the lid member 20, the seal control member 40 has a button 41, a valve unit 42 and a spring 43. The column is formed on the button 41 and facing the opening 22, the valve unit 42 is passed through the opening 22, a first end of the valve unit 42 is covering the opening 22 and a second end of the valve unit 42 is connected the column. The spring 43 is mounted on the column and two ends of the spring 43 is abutting the button 41 and the channel 21.

The opening 22 is covering the valve unit 42 through an elastic force of the spring 43 abutting the button 41 and the channel 21. When users press the button 41, the spring 43 is compressed and the opening 22 is uncovered, meanwhile, users cover the lid member 20 on the container body 10, an airflow passes through the opening 22 foreword to external of the container 1, next, the opening 22 is sealed by the first end of the valve unit 42 and negative air pressure is forming in the container 1 after releasing the button 41 such that the container 1 is airtight and the lid member 20 is not easy to uncover if users do not press the button 41.

Figure 3:
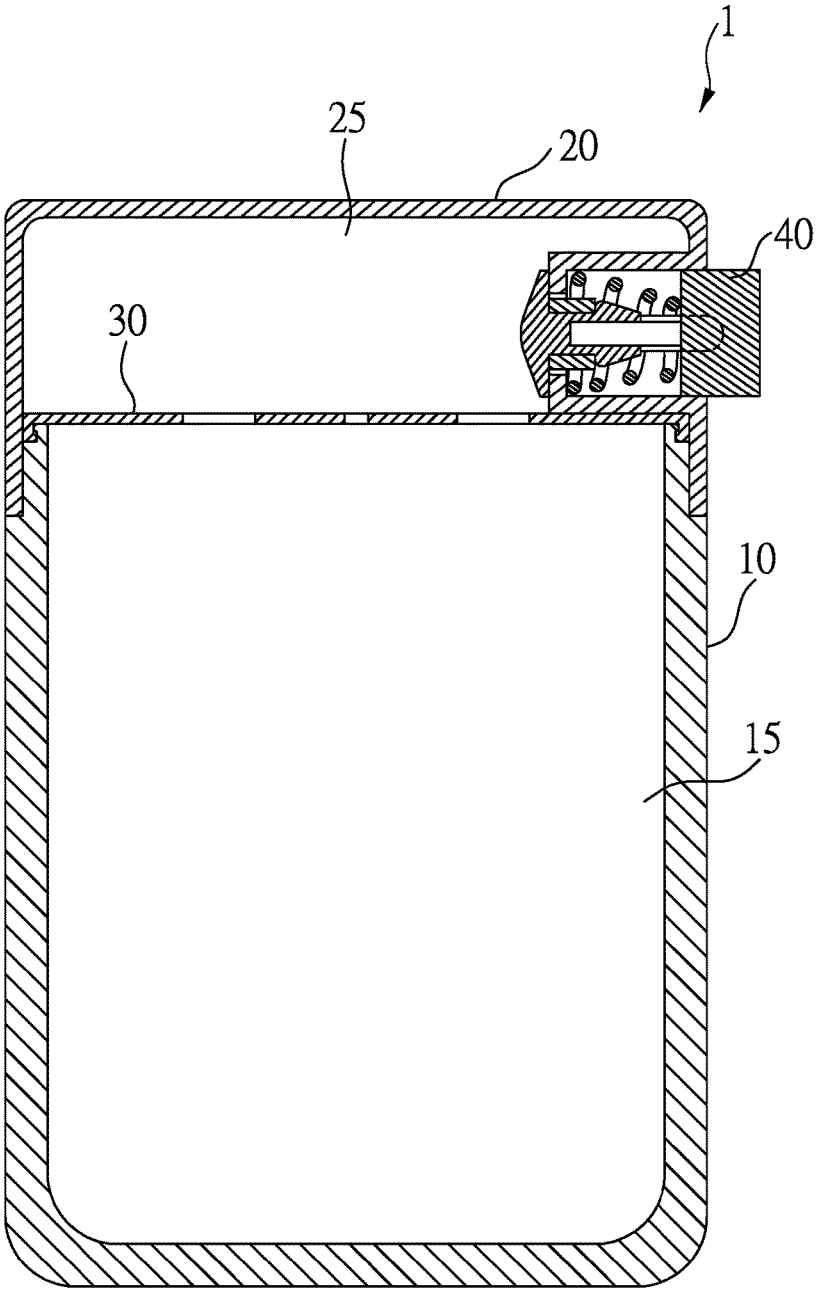
FIG. 3 is a cross-sectional view of the container.
Figure 4:
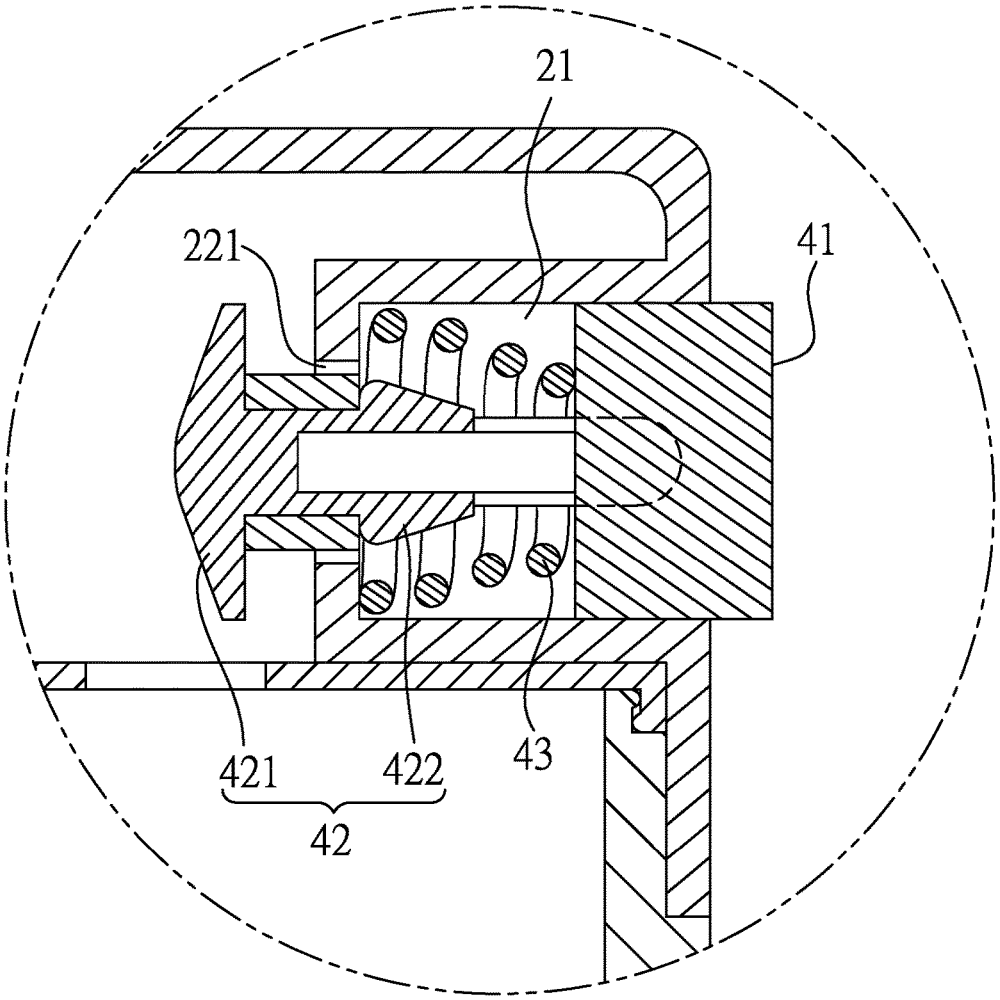
FIG. 4 is a partial enlarged view of the container shown in FIG. 3.
Figure 5:
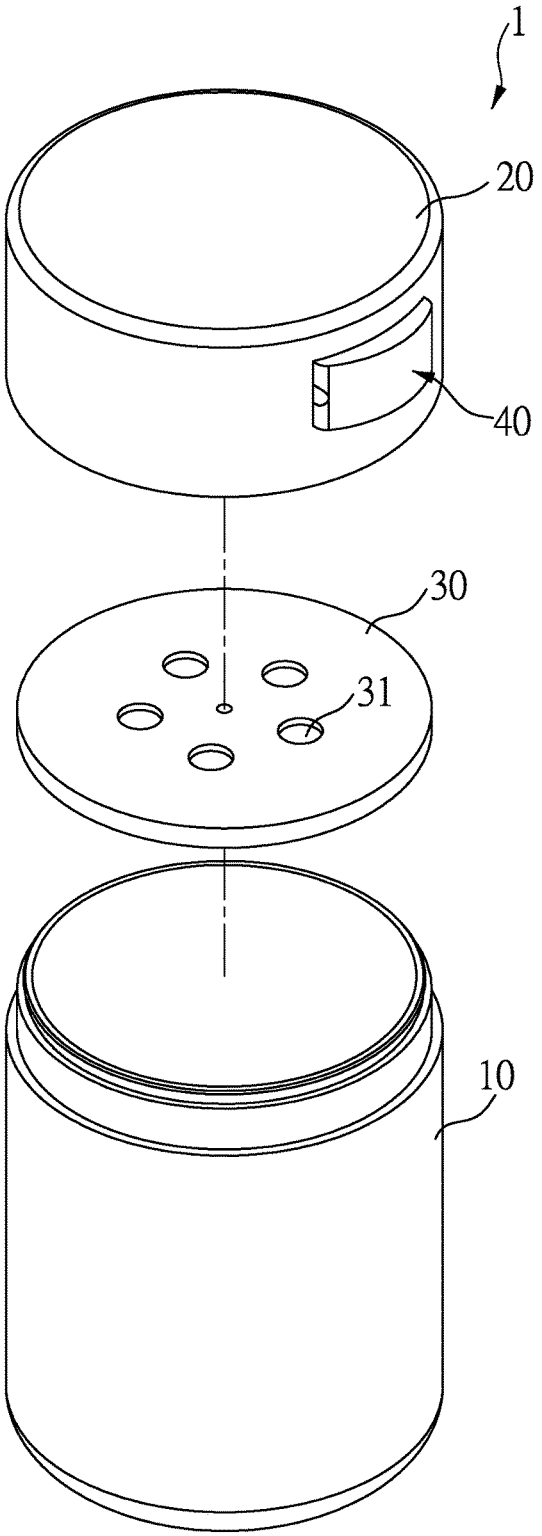
FIG. 5 is another perspective view of the container in accordance with the preferred embodiment of the present invention with one type sieve.
Figure 6:
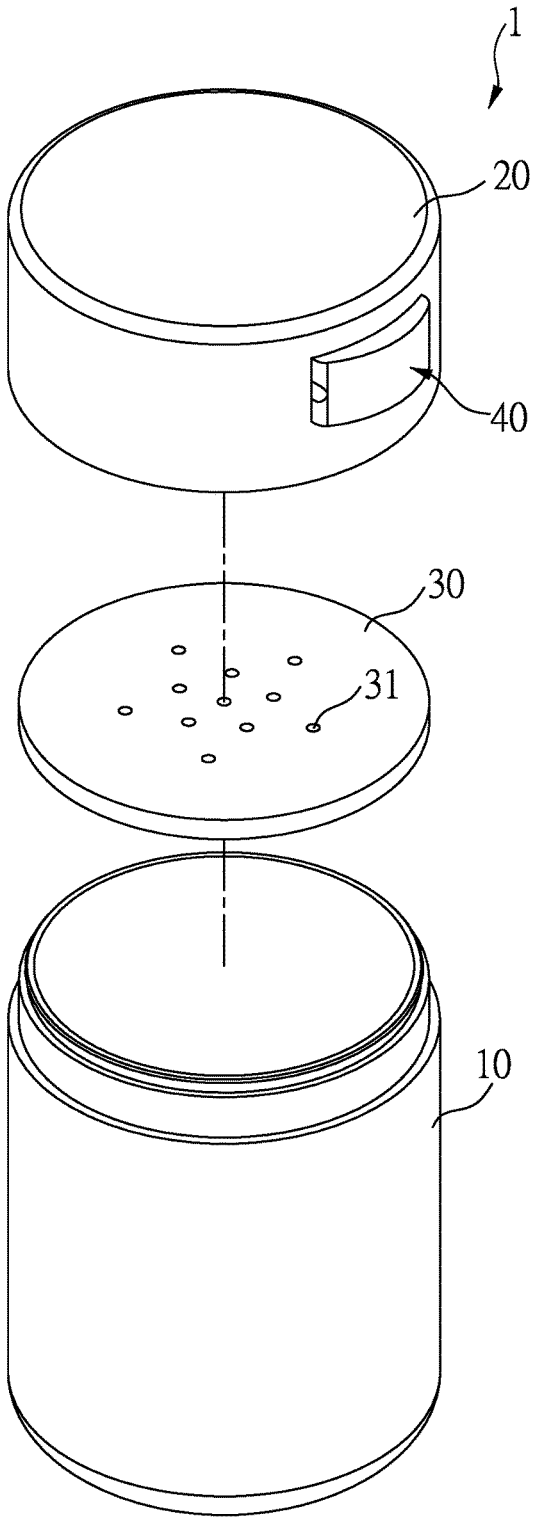
FIG. 6 is another perspective view of the container in accordance with the preferred embodiment of the present invention with different type sieve.
Figure 7:
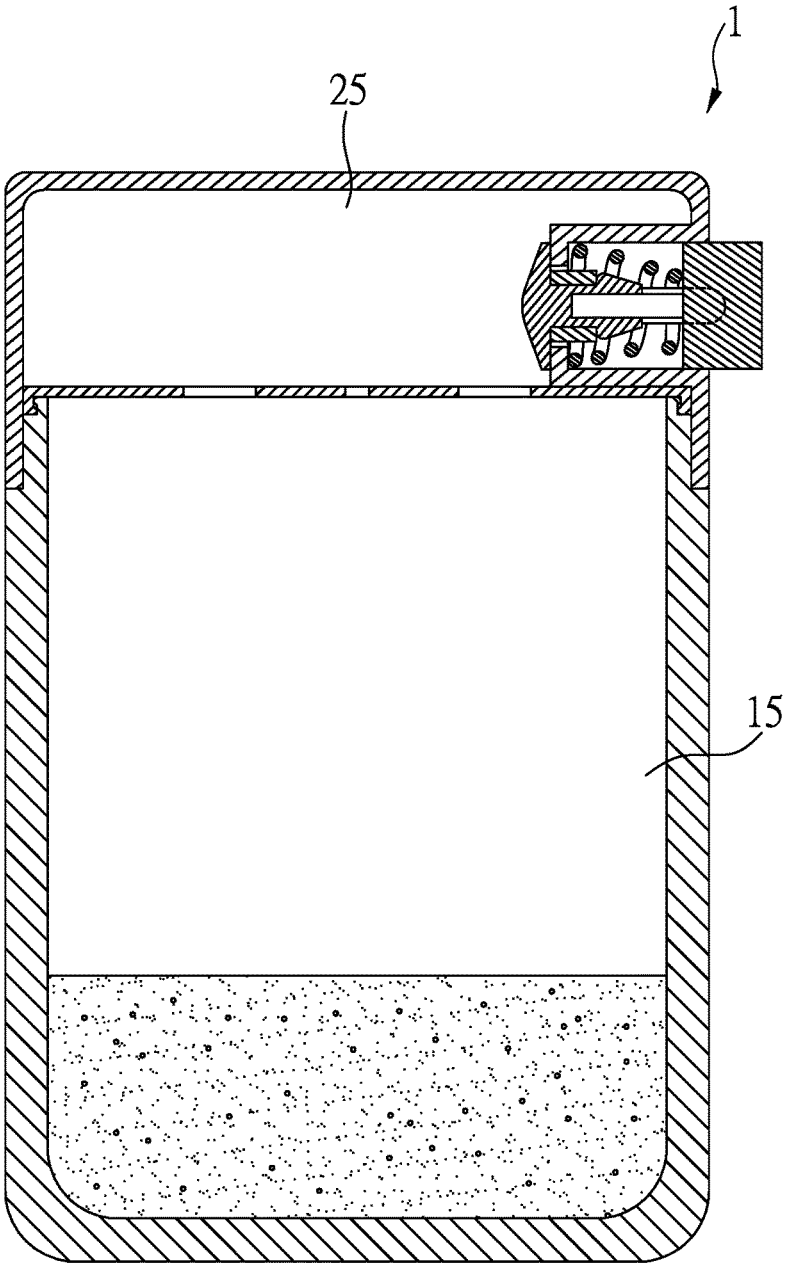
FIG. 7 is a schematic diagram of the container in accordance with the preferred embodiment of the present invention loaded with seasoning.

Referring to FIGS. 3 and 7, the sieve 30 covers the container body 10 and defines the space in the container 1 into the storage chamber 15 and the buffer chamber 25. The sieve 30*s* as shown in FIGS. 5 and 6, have different type such as different pattern or hole 31 size for different kinds of seasoning like pepper, cayenne pepper, or sesame. Users cover the lid member 20 on the container body 10, the sieve 30 as an obstacle prevents the seasoning spray out from the container body 10, and the lid member 20 can keep clean, as well as less seasoning falls off from the lid member 20 when opening 22 the container 1. Moreover, the sieve 30 isolates the seasoning from the opening 22 and the lid member 20, also gives a buffer chamber 25. When pressing the button 41, the airflow does not directly impact the seasoning to spay or contaminate the lid member 20. Users can choice different type sieve 30 corresponding to different type seasoning to advance the efficiency of keeping lid member 20 clean.

Figure 2:
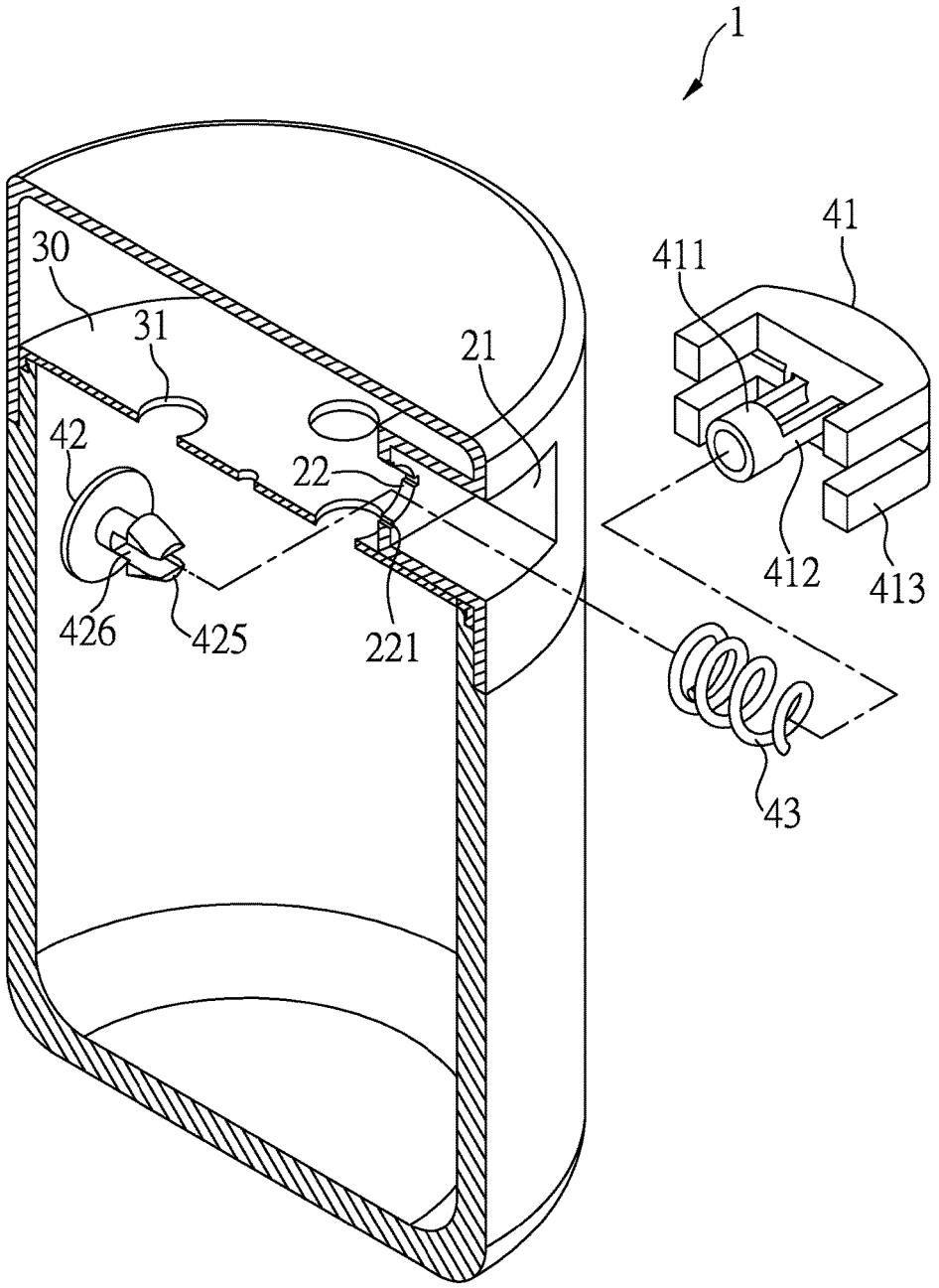
FIG. 2 is a cross-sectional, exploded perspective view of the container in FIG. 1.

As FIG. 2 shows, the opening 22 includes four sub opening 221 formed on periphery of the opening 22 within the channel 21, when pressing or releasing the button 41, the airflow is easier to pass through the opening 22, especially if the diameter of valve unit 42 is closes on the opening 22.

On the other hand, in one preferred embodiment of present invention, the column of button 41 is a hollow column 411 and the second end of the valve unit 42 is detachable plugged into the hollow column 411. The valve unit 42 includes a pair of hooks 421 engaged into the hollow column 411 so as to allow the valve unit 42 to be quickly secured to the hollow column. If the valve unit 42 was deformed or loose, it can be replaced easily.

In other embodiment of present invention, the button 41 is slidably engaged in the channel 21 and includes a tube 411 extended therefrom and having a pair of engaging shoulders 412 formed therein. The button 40 includes four projections 413 for engaging with the lid member 20 so as to prevent the button 41 from engaging into the channel 21 of the lid member 20.

The second end 422 of valve unit 42 includes a pair of hooks 425 engaged into the tube 411 of the button 41 and for engaging with the engaging shoulders 413 of the tube 31 so as to allow the valve unit 42 to be quickly secured to the tube 411 of the button 41. The valve unit 42 includes a slit 426 formed between the hooks 421 so as to increase the resilience of the hooks 425. The spring 43 is engaged on the tube 411 and is biased between the button 41 and the valve unit 42 so as to bias the button 41 partially outward of the lid member 20 and so as to force the valve unit 42 against the lid member 20 for enclosing the opening 22.

In operation, when the button 41 is depressed inward of the channel 21, the valve unit 42 is disengaged from the opening 22 such that the opening 22 is opened and such that air is allowed to flow inward or flow outward of the lid member 20. The sieve 30 as an obstacle prevent the seasoning spray out from the storage chamber 15, and the lid member 20 can keep clean, as well as less seasoning falls off from the lid member 20 when opening the container 1. Moreover, the sieve 30 isolates the seasoning from the valve unit 43 and the lid member 20, also gives a buffer chamber 25 for preventing the lid member 20 from contamination of seasoning.

What is claimed is:

1. An airtight container, comprising:

a container body;

a lid member covering on the container body, a channel formed on the lid member and the channel defining an opening therein, the opening including at least one sub opening formed on a periphery of the opening;

a sieve disposed on the container body and facing the lid member, the sieve defining a storage chamber and a buffer chamber in the container on both sides of the sieve respectively;

a seal control member moveably disposed in the channel of the lid member, operable sealing the opening of the lid member, the seal control member having a button, a valve unit, and a spring; a column formed on the button and facing the opening, the valve unit passed through the opening, a first end of the valve unit covering the opening and a second end of the valve unit connected the column, the spring mounted on the column and two ends of the spring abutting the button and the channel; and wherein the opening is uncovered when pressing the button, and covering the lid member on the container body such that forming the negative air pressure in the container after releasing the button.

2. An airtight container as recited in claim 1, wherein the column is a hollow column and the second end of the valve unit is detachably plugged into the hollow column.

3. An airtight container, comprising:

a container body including an open top;

a lid member engaged on top of said container body for enclosing said open top of said container body, said lid member including a channel formed therein and including an opening formed therein and communicating with said channel, the opening including at least one sub opening formed on a periphery of the opening;

a sieve disposed in the container body and facing the lid member, the sieve defining a storage chamber and a buffer chamber in the container on both sides of the sieve respectively;

a button slidably engaged in said channel and including a tube extended therefrom and having a pair of engaging shoulders formed therein, said button including at least one projection for engaging with said cover so as to prevent said knob from engaging into said channel;

a valve unit including a pair of hooks extended therefrom and a slit formed between said hooks, said hooks being engaged into said tube and engaged with said engaging shoulders of said tube so as to allow said plug to be secured to said tube; and a biasing means biased between said knob and said plug for biasing said knob partially outward of said cover and for forcing said plug against said cover and for enclosing said opening.

* * * * *